US005263328A

United States Patent [19]

Rohde

[11] Patent Number: 5,263,328

[45] Date of Patent: Nov. 23, 1993

[54] PROCESS FOR LOW-TEMPERATURE AIR FRACTIONATION

[75] Inventor: Wilhelm Rohde, Munich, Fed. Rep. of Germany

[73] Assignee: Linde Aktiengesellschaft, Wiesbaden, Fed. Rep. of Germany

[21] Appl. No.: 857,140

[22] Filed: Mar. 25, 1992

[30] Foreign Application Priority Data

Mar. 26, 1991 [DE] Fed. Rep. of Germany ..... 4109945

[51] Int. Cl.[5] ..... F25J 3/02

[52] U.S. Cl. ..... 62/25; 62/38

[58] Field of Search ..... 62/38, 39, 13, 25

[56] References Cited

U.S. PATENT DOCUMENTS

| | | | |
|---|---|---|---|
| 4,152,130 | 5/1979 | Theobald | 62/18 |
| 4,303,428 | 12/1981 | Vandenbussche | 62/38 |
| 4,715,873 | 12/1987 | Auvil et al. | 62/38 |
| 4,746,343 | 5/1988 | Ishizu et al. | 62/38 |
| 4,883,518 | 11/1989 | Skolaude et al. | 62/38 |
| 5,080,703 | 1/1992 | Rathbone | 62/38 |
| 5,114,449 | 5/1899 | Agrawal et al. | 62 22/ |

FOREIGN PATENT DOCUMENTS 3643359 6/1988 Fed. Rep. of Germany .

*Primary Examiner*—Ronald C. Capossela

*Attorney, Agent, or Firm*—Millen, White, Zelano & Branigan

[57] ABSTRACT

For the low-temperature fractionation of air, especially for the production of medium purity oxygen, the entire feed air (1) is compressed in a first compressor stage (2) and purified by adsorption (4). A first component stream (101) of the air is introduced into the high-pressure stage (7) of a two-stage rectifying column (6). A second component stream is passed to the low-pressure stage (8), and this stream is separated, after adsorption (4), from the remaining feed air, heated against compressed feed air (3), and engine-expanded (13). The thus-produced work is utilized at least in part for the compression (2) of feed air.

17 Claims, 2 Drawing Sheets

PROCESS FOR LOW-TEMPERATURE AIR FRACTIONATION

BACKGROUND OF THE INVENTION

This invention relates to a process for the low-temperature fractionation of air wherein feed air is compressed, purified, cooled, and, divided into several component streams, is introduced into the high-pressure stage and into the low-pressure stage of a two-stage rectifying device, a first component stream being fed to the high-pressure stage and a second component stream being fed to the low-pressure stage.

Such a process is described in EP-A 0,342,436 wherein the feed air is initially compressed only to the pressure of the low-pressure stage and is divided thereafter into first and second component streams. Only the first component stream, introduced in part into the high-pressure stage, is further compressed. Although this process provides a very economical utilization of the compression energy, it is necessary to perform the removal of carbon dioxide, hydrocarbons and water from the second component stream in a separate purification stage, usually a molecular sieve station. On account of the low pressure, this molecular sieve requires large quantities of regenerating gas. In turn, such quantities then are no longer available for other purposes, particularly for an economical evaporative cooling of the cooling water needed for the precooling of the air.

SUMMARY OF THE INVENTION

An aspect of one object of the invention is to provide an even more economical a process of the type discussed hereinabove, and especially to a process encompassing a more economical air purification stage.

Upon further study of the specification and appended claims, further objects and advantages of this invention will become apparent to those skilled in the art.

These objects are attained by providing that the feed air, in a first compressor stage, is brought to approximately the pressure of the high-pressure stage, is then purified by adsorption in a purification stage, and subsequently is divided into first and second component streams. The second component stream prior to being fed into the low-pressure stage is heated in indirect heat exchange against compressed feed air and is engine-expanded, and the work obtained during expansion of the second component stream is utilized for the compression of a process stream, especially feed air. (By approximately the pressure of the high pressure stage is generally meant a pressure which slightly exceeds the pressure of the high pressure stage at least by the pressure drop caused by the purification means and by the flow resistance inside the lines between compressing means and high pressure stage.)

It is possible by performing the process in accordance with this invention to treat the entire feed air in a single purification stage, namely under high-pressure stage pressure. The initial outlay and the high operating expenditure for an additional low-pressure purification stage are eliminated. The excess compression energy imparted to the second component stream can, in a turbine, be in part recovered as mechanical work, and, in part, can be converted into cold, i.e., refrigeration values.

Normally, the work is transferred completely and directly by mechanical coupling to a compressor, but additionally or alternatively, it is also possible to drive a generator. In order to perform the engine expansion under favorable conditions, the second component stream is first heated up and during this step, heat can be favorably withdrawn from the compressed feed air.

A product stream or an intermediate-product stream can flow, for example, through the compressor driven by the turbine. In general, utilization of the work obtained during engine expansion for the compression of feed air is the most advantageous step.

In addition, cold can be produced in the process by branching off a third component stream downstream of the adsorption stage, subjecting this stream to recompression in a second compressor stage. The recompressed stream is then cooled, engine expanded, and fed into the low-pressure stage. The work obtained during the engine expansion of the third component stream is used for the recompression of the third component stream in the second compressor stage. In this step, pressure that is not needed is likewise used for the generation of process cold.

The invention makes two procedures available for the transfer of work and cold:

In the first version, work obtained during the engine expansion of the second component stream can be utilized for driving the first compressor stage. Since this work is, by itself, insufficient for driving the air compressor, the shaft usually connecting the expansion turbine and the first compressor stage must be additionally driven by a motor.

It is furthermore advantageous to perform the heating of the second component stream before its expansion by indirect heat exchange with feed air downstream of the first compressor stage and upstream of the purification stage. At this point, the feed air must be precooled in any case. The feed air normally exits from a cooler, operated with cooling water of about 25° C., at a temperature of about 35° C., but the feed air must be further cooled to about 10° C. to 15° C. for adsorption in the purification stage. This additional cooling is generally accomplished by an external refrigeration facility or by providing cooling water from an evaporative cooler with dry nitrogen from the distillation column. Some of this precooling step can now be accomplished at least in part by the purified second component stream so that the costs for the refrigerating facility are reduced or, alternatively, the nitrogen can be used for other purposes.

In a second version, work obtained in the engine expansion of the second component stream is utilized in a third compressor stage for the recompression of the third component stream. This third compressor stage is preferably placed upstream of the second compressor stage and serves to increase the pressure difference during the expansion of the third component stream.

It is furthermore advantageous to branch off an additional or alternative fourth component stream downstream of the purification stage, to recompress this stream in a fourth compressor stage, then cool the stream, expand it, and feed it into the high-pressure stage wherein work obtained during the engine expansion of the second component stream is utilized for the recompression of the fourth component stream in the fourth compressor stage. The expansion of the fourth component stream is generally accomplished by a throttle valve.

(The numbering of the compressor stages here introduced is solely for clearly distinguishing these stages; it does not mean that, in case of the existence of a fourth compressor stage, the aforementioned second or third compressor stage must necessarily also be present.)

Moreover, it proved to be advantageous to recompress the third and fourth component streams in a joint third compressor stage. The third and fourth compressor stages are in this case conducted in a relatively economical manner in a single machine.

A second way of transferring heat to the second component stream under high pressure resides, according to a further aspect of the invention, in performing the heating of the second component stream prior to its expansion by indirect heat exchange with the third and/or fourth component stream after recompression in the third or, respectively, fourth compressor stage.

By virtue of this heat exchange wherein recompressed gas is cooled, an especially advantageous adaptation of the streams to the inlet temperature of the main heat exchanger can be attained. The cold values available prior to the second component stream entering the expansion turbine are utilized with particularly high efficiency at this point.

Recompression of the fourth component stream to above the high-pressure column is advantageous, if oxygen under elevated pressure is to be obtained in the process. In this connection, in an advantageous further development of the idea of this invention, liquid oxygen is discharged from the low-pressure stage, pressurized, and vaporized in indirect heat exchange with the recompressed fourth component stream. In this case, the partial quantity of air available under a pressure higher than the high-pressure column pressure is utilized for an advantageous energy-efficient production of pressurized oxygen. The oxygen is pressurized in the liquid form (either by a pump or by exploiting a hydrostatic potential) and is subsequently vaporized under the elevated pressure. The high-pressure air is condensed countercurrently to evaporating oxygen and thereby gives off latent heat. The indirect heat exchange is preferably effected in the main heat exchanger which is also traversed by the other feed and product streams.

In this connection, it is advantageous to introduce the partially condensed fourth component stream into the high-pressure stage at a feed-point above the feed-point of the first component stream. The reason for this is that most of the high-pressure air in the recompressed fourth component stream will be condensed during heat exchange with pressurized oxygen, so that a certain preliminary separating effect is obtained. Consequently, the condensate is introduced at least one theoretical plate, preferably about four to eight theoretical plates, above the feed-point of the first component stream passed into the high-pressure stage.

Utilization of the process according to this invention for obtaining low-purity oxygen is particularly advantageous. In the present context, this means oxygen purities by volume of below 99%, preferably between 85% and 98%. The advantages of the invention become especially clearly apparent in larger air fractionation facilities (more than 100,000 $Nm^3/h$, preferably more than 200,000 $Nm^3/h$, most preferably between 200,000 and 400,000 $Nm^3/h$ of fractionation air). Particularly advantageous is the utilization of this invention in GUD (combined cycle) installations or in installations for steel production (e.g., the COREX process).

BRIEF DESCRIPTION OF THE DRAWINGS

The invention and further details of the invention will be described more specifically below with reference to two preferred comprehensive embodiments schematically illustrated in FIGS. 1 and 2. Insofar as possible, the same reference symbols are utilized in both drawings for analogous process steps.

DETAILED DESCRIPTION

Figure 1:
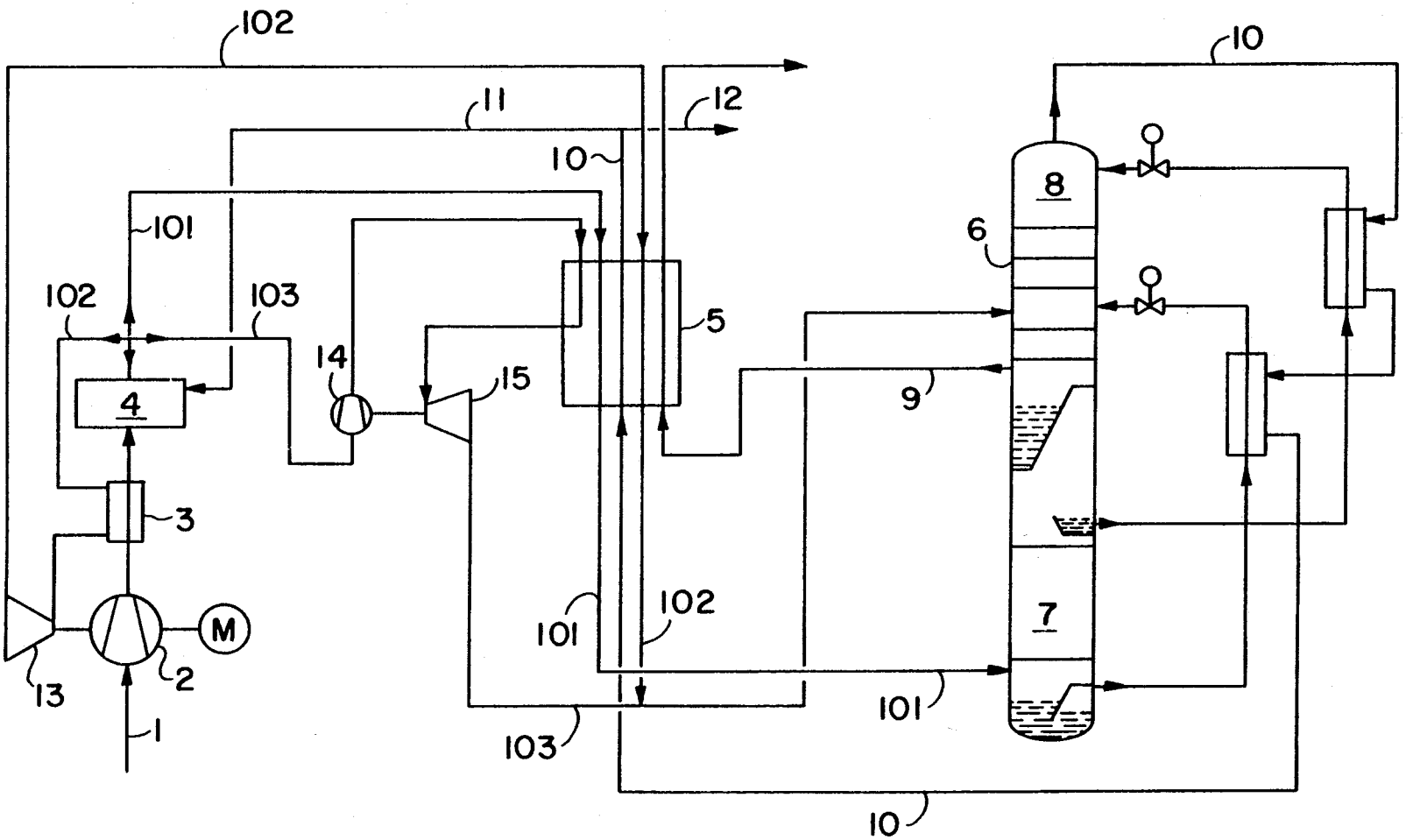

In accordance with the process scheme of FIG. 1, atmospheric air is taken in via a conduit 1 by a first compressor stage 2 and compressed to a pressure of 5–10 bar, preferably about 5.65 bar, cooled to 5°–25° C., preferably about 12° C., and freed of impurities, such as, for example, water, carbon dioxide and hydrocarbons, in a purification stage 4 filled with a commercial molecular sieve capable of removing these impurities, e.g., 13× produced by Union Carbide Corporation.

Directly downstream of the purification stage 4, the feed air is split into a first component stream 101 and into a second component stream 102. The first component stream 101 is cooled in main heat exchanger 5 against product streams and introduced into the high-pressure stage 7 of a conventional two-stage rectifying column 6. Gaseous oxygen 9 and gaseous nitrogen 10 are withdrawn as the products from the low-pressure stage 8 (operating pressure 1.2–1.6 bar, preferably about 1.3 bar) and heated in main heat exchanger 5 to approximately ambient temperature. The nitrogen can be utilized for regenerating the molecular sieve of the purification stage 4 (conduit 11) and/or can also be removed via conduit 12 for other purposes, for example to cool the cooling water in a evaporative cooler.

The second component stream 102 is heated, in accordance with this invention, in a heat exchanger 3 against the compressed feed air, expanded in a turbine 13, cooled, and blown into the low-pressure stage 8. The feed air stream can be additionally cooled between heat exchanger 3 and purification stage 4 (not shown in the drawing), for example by indirect heat exchange with water cooled by evaporative cooling.

A third component stream 103 is likewise branched off downstream of the purification stage 4, further compressed in a second compressor 14, cooled to a medium temperature in the main heat exchanger 5, and thereafter expanded in a turbine 15 for cold production. The work obtained during expansion of the component stream is mechanically transferred to the second compressor 14. The expanded third component stream 103 is introduced into the low-pressure stage 8 together with the expanded and cooled second component stream 102.

In the process of FIG. 1, the proportion of streams, based on the total feed are generally—stream 101: about 60 to 70%; stream 102: about 25 to 35%; and stream 103 about 4 to 8%.

Figure 2:
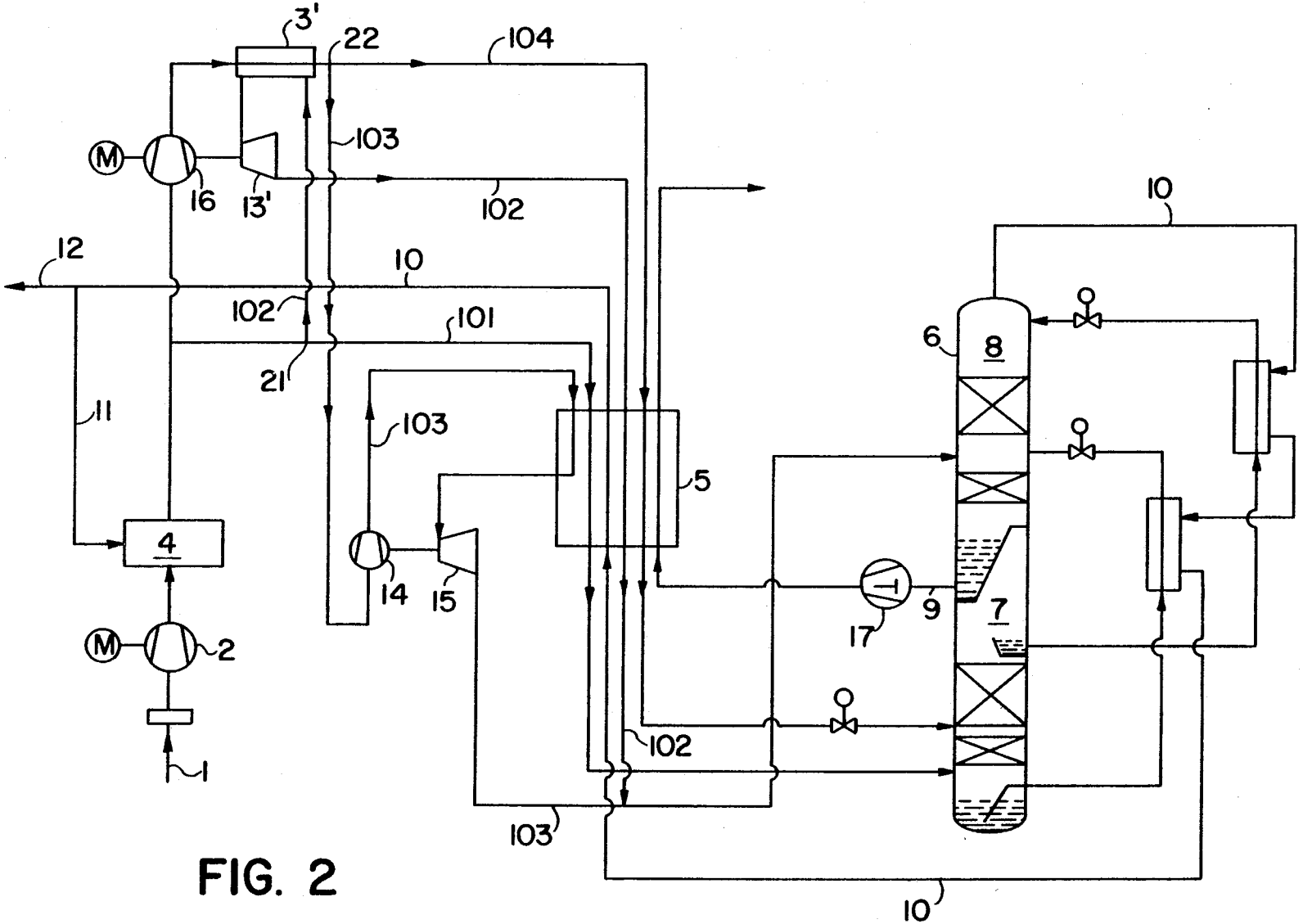

FIG. 2 shows an embodiment for a second version of the process according to this invention. In this version, the second component stream is branched off from the first component stream 101 at a branching point 21, heated in heat exchanger 3', and expanded in the turbine 13'. The thus-obtained work is transferred to a third compressor 16.

The third component stream is compressed in the third compressor to a pressure of at least 15 bar, preferably about 20–50 bar, and then cooled in heat exchanger 3' against the second component stream 102 prior to expansion of the latter, before reaching the second recompressor 14 coupled with the turbine 15.

Downstream of the third compressor stage 16 and the heat exchanger 3', a fourth component stream 104 is branched off (22) from the third component stream, cooled in main heat exchanger 5, and throttled into the high-pressure stage 7. Countercurrently thereto, oxygen is vaporized after being withdrawn via conduit 9 from the low-pressure stage and brought to a pressure of at least 4 bar, preferably 20–100 bar, by a pump 17. The high-pressure air in the fourth component stream is almost entirely condensed during heat exchange and is introduced into the high-pressure stage 7 above the feed-point of the first component stream 101.

The process according to this invention with direct feeding of feed air into the low-pressure stage proves to be economically advantageous for producing oxygen having a purity of 85–98%. In case an oxygen purity of, for example, 96% is desired, then up to 35% of the feed air can be directly introduced into the low-pressure stage by way of the second and third component streams 102, 103, without there being a marked reduction in the oxygen yield.

The proportions of the streams in the process of FIG. 2, based on the total feed are generally—stream 101: about 40 to 50%; stream 102: about 25 to 35%; stream 103: about 4 to 8%; and stream 104: about 15 to 25%.

The entire disclosures of all applications, patents and publications, cited above, and of corresponding application Federal Republic of Germany P 41 09 945.1, filed Mar. 26, 1991, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the low temperature fractionation of air in a two-stage rectification column (6) having a high pressure stage (7) and a low pressure stage (8), comprising:

compressing raw feed air (1) in a first compressor stage (2) to approximately high-pressure stage pressure;

purifying the compressed raw feed air by adsorption in a purification sage (4) to obtain compressed, purified feed air;

dividing the compressed, purified feed air into a first component stream (101) and a second component stream (102);

heating the second component stream in indirect heat exchange (3, 3') against the compressed raw feed air or the compressed, purified feed air so as to cool the compressed raw and compressed, purified feed air;

engine-expanding (13, 13') the heated second component stream so as to cool the second component stream and to provide work for the compression (2, 16) of a process stream;

conducting the resultant engine-expanded second component stream to the low pressure stage (8); and conducting the first component stream to a feedpoint in the high pressure stage.

2. A process according to claim 1, wherein work obtained during the engine expansion (13) of the second component stream is utilized for driving the first compressor stage (2).

3. A process according to claim 2, wherein the indirect heating of the second component stream is conducted against compressed raw feed air.

4. A process according to claim 1, wherein a third component stream (103) is branched off downstream of the purification stage (4), recompressed in a second compressor stage (14), then cooled (5), engine-expanded (15), and fed into the low-pressure stage (8), wherein work obtained during the engine expansion (15) of the third component stream is used for the recompression of the third component stream in the second compressor stage (14).

5. A process according to claim 4, wherein work obtained during the engine expansion (13') of the second component stream is utilized in a third compressor stage (16) for the recompression of the third component stream.

6. A process according to claim 4, wherein a fourth component stream (104) is branched off downstream of the purification stage (4), recompressed in a fourth compressor stage (16), then cooled (5), expanded, and fed into the high-pressure stage (7), wherein work obtained during the engine expansion (13') of the second component stream is utilized for the recompression of the fourth component stream in the fourth compressor stage (16).

7. A process according to claim 6, wherein the third and fourth component streams are recompressed in a joint third compressor stage (16).

8. A process according to claim 6, wherein the indirect heating of the second component stream is performed against at least one of the recompressed third and fourth component streams.

9. A process according to claim 6, wherein liquid oxygen is withdrawn (9) from the low-pressure stage (8), is pressurized (17), and is then vaporized in indirect heat exchange (5) with the recompressed fourth component stream (104).

10. A process according to claim 9, wherein the fourth component stream (104) is at least partially condensed during indirect heat exchange (5) with evaporating oxygen and resultant stream is then introduced into the high-pressure stage (7) at a point above the feed-point first component stream (101).

11. A process according to claim 4, wherein work produced during the engine expansion (13) of the second component stream is utilized for driving the first compressor stage (2).

12. A process according to claim 11, wherein the indirect heating of the second component stream is conducted against compressed raw feed air downstream of the first compressor stage (2) and upstream of the purification stage (4).

13. A process according to claim 1, wherein said process stream is feed air.

14. A process according to claim 1, wherein the indirect heating of the second component (102) is conducted against the compressed raw feed air.

15. A process according to claim 14, the indirect heating of the second component (102) is conducted against the compressed purified feed air.

16. A process according to claim 15, wherein the indirect heating is conducted against a portion of the compressed purified feed air.

17. A process according to claim 14, wherein the indirect heating is conducted against the entire compressed raw feed air.

* * * * *